US005393019A

United States Patent [19]

Ortiz-Rivas

[11] Patent Number: 5,393,019

[45] Date of Patent: Feb. 28, 1995

[54] RAILROAD TURNOUT FROG WITH CONTINUOUS RUNNING SURFACE

[76] Inventor: Arturo A. Ortiz-Rivas, Manuel Ma De Llano, No. 1104-D OTE, Monterrey, N.L., Mexico

[21] Appl. No.: 237,616

[22] Filed: May 3, 1994

[30] Foreign Application Priority Data

May 4, 1993 [MX] Mexico ..... 22806

[51] Int. Cl.[6] ..... E01B 7/00

[52] U.S. Cl. ..... 246/468; 246/460; 246/463; 246/470

[58] Field of Search ..... 246/460, 454, 463, 468, 246/469, 470, 471, 430, 472, 435 R, 438, 442, 462

[56] References Cited

U.S. PATENT DOCUMENTS

| | | | |
|---|---|---|---|
| 881,984 | 3/1908 | Weaver et al. | 246/472 |
| 889,199 | 6/1908 | Canty | 246/463 |
| 1,668,169 | 5/1928 | Palmer | 246/463 |
| 2,149,426 | 3/1939 | Enstrom | 246/468 |
| 2,853,260 | 9/1958 | Simmons et al. | 246/468 |
| 3,787,680 | 1/1974 | Perrot | 246/468 |
| 4,081,162 | 3/1978 | Frank | 246/468 |
| 5,133,522 | 7/1992 | Testart | 246/468 |

FOREIGN PATENT DOCUMENTS

| | | | |
|---|---|---|---|
| 0009290 | of 1908 | United Kingdom | 246/471 |
| 0362409 | 5/1930 | United Kingdom | 246/463 |

OTHER PUBLICATIONS

Railway Track & Structures, Jul. 1990, pp. 22–26, 56.
Railway Track & Structures, Dec. 1990, pp. 11–13.
Railway Track & Structures, Mar. 1991, pp. 32–35.
Railway Track & Structures, Sep. 1991, pp. 35–38.
Railway Track & Structures, Apr. 1992, pp. 17–19.
Railway Track & Structures, Jul. 1992, pp. 20–22.
Railway Track & Structures, Nov. 1992, pp. 19–22, 23–29.
Railway Track & Structures, Apr. 1993, pp. 24–28.
Railway Track & Structures, Jul. 1993, pp. 19–22.
Railway Track & Structure Track Buyer's, 1993, pp. 22–25.

*Primary Examiner*—Mark T. Le
*Attorney, Agent, or Firm*—Pravel, Hewitt, Kimball & Krieger

[57] ABSTRACT

An improved railroad turnout frog with a continuous running surface is provided. The frog provides for continuous running of the rolling stock and includes a mobile point with a triangular shape. The mobile point is located in a portion of the frog which would be void and otherwise provide no structural support.

11 Claims, 3 Drawing Sheets

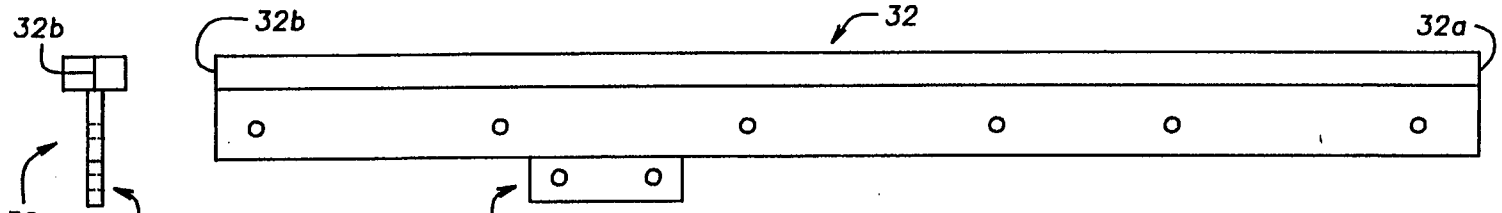
FIG. 3
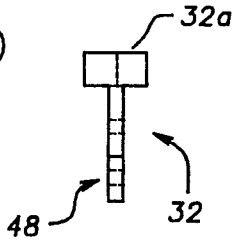
FIG. 6
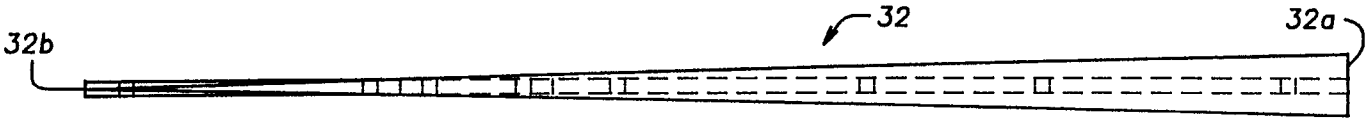
FIG. 4
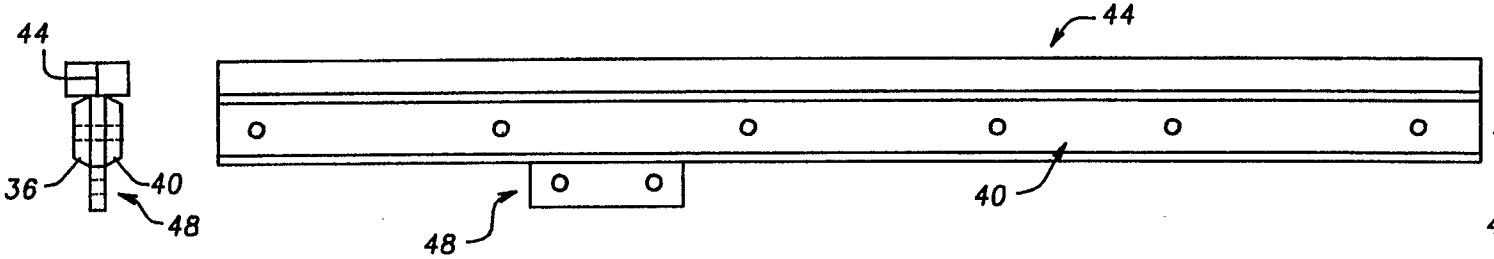
FIG. 7
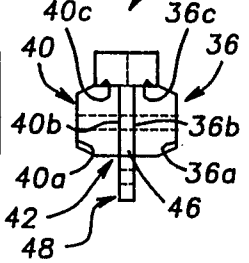
FIG. 10
FIG. 5
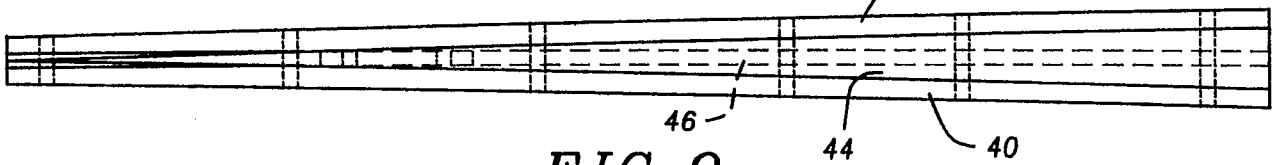
FIG. 9
FIG. 8

RAILROAD TURNOUT FROG WITH CONTINUOUS RUNNING SURFACE

CROSS-REFERENCE TO RELATED APPLICATION

The present application and applicant's co-pending U.S. patent application Ser. No. 08/237,589. "IMPROVED FROG WITH INTERCHANGEABLE INSERT," filed of even date with the present application, both relate to frogs for railroad turnouts.

BACKGROUND OF INVENTION

1. Field of the Invention

The present invention relates to frogs for turnouts of railroad tracks, particularly those for high speed railways.

2. Description of the Related Art

At the present, railroad turnouts are a set of pieces placed to divert railroad rolling stock from one set of tracks to another set of tracks. One of these elements is known as a frog.

There are several known types of frogs. A first type are solid manganese steel frogs, which are made by being cast in one piece. Another type are the bolted rigid frogs which are made of same material as the rail. Still another type are the rail-bound, manganese steel frogs which are a combination of the solid and bolted frogs.

All of these frogs have a location in them known as a half point, which is the end of the curvature to divert the rolling stock. So far as is known, between the half point and the wings of the frog, there has been a hollow or void which interrupts the normal support of the rolling stock on the rail. At this location, because of the absence of support, strong lateral impacts are produced against the frog wing, and balance in the railcars is affected also. In order to reduce these undesirable effects, the rolling stock must run through the turnouts at reduced speeds.

SUMMARY OF INVENTION

Briefly, the present invention provides a new and improved railroad turnout frog with a continuous running surface by means of a mobile point. A mobile point according to the present invention is located in a railroad frog where first and second wings converge toward each other to form the juncture with a long point rail and a short point rail. The long point rail and the short point rail form a flat vertical surface at a point of juncture.

A mobile point according to the present invention is located adjacent this flat surface. The mobile point abuts the flat vertical surface at the point of juncture between the long and short point rails. The mobile point extends from the flat surface at the point of juncture to a throat between the first and second wings. The mobile point member includes a first or left point, filler member mounted extending forwardly from the point of juncture to the throat. The first point filler member has a first side surface fitting along a web of the first wing.

A second point filler member is another part of the mobile point member. The second point filler is also mounted extending forwardly from the point of juncture to the throat. The second point filler has a second side surface fitting along a web of the second wing. The first and second point filler members each have second or opposite side surfaces forming a gap between them along their forward extent. Further, the first and second wing filler members also have a flat upper surface formed thereon adjacent the gap. An interchangeable insert is provided having a central bar insertable in the gap between the first and second point filler members. The insert is mountable on the flat upper surfaces of the wing filler members.

The mobile point member of a frog according to the present invention slides transversely between alternate positions where it is lined up parallel to one or the other of the wings of the frog. The mobile point is supported on the upper and angled part of the rail base and laterally supported against the internal face of the wing rail, providing a continuous running surface. Therefore traffic on the railroad is not required to diminish speed when running through the turnout.

BRIEF DESCRIPTION OF THE DRAWINGS

The characteristic details of the present invention are clearly shown in the following description and accompanying figures which illustrate this and provide points of reference to indicate the same parts in the figures shown.

FIG. 3 is a front view of a mobile point component.

FIG. 4 is an elevation view of the mobile point of FIG. 3.

FIG. 5 is a top view of the mobile point of FIG. 3.

FIG. 6 is a rear view of the mobile point of FIG. 3.

FIG. 7 is a front view of the assembled mobile point and filler components of FIG. 1.

FIG. 8 is an elevation view of the assembled components of FIG. 7.

FIG. 9 is a top view of the assembled components of FIG. 7.

FIG. 10 is a rear view of the assembled components of FIG. 7.

DESCRIPTION OF PREFERRED EMBODIMENT

Figure 1:
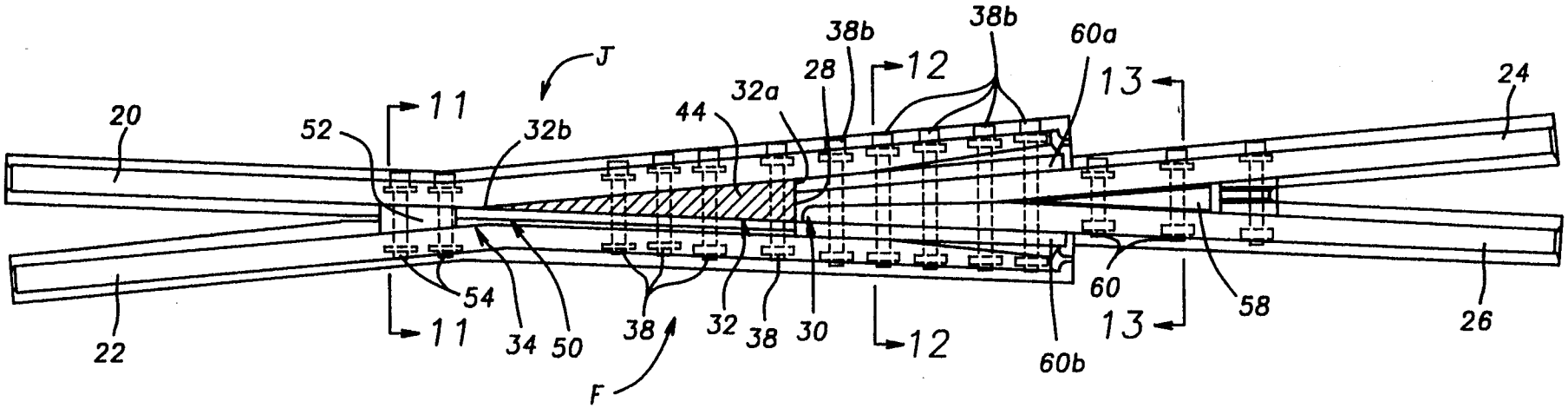
FIG. 1 is a plan view of a standard improved frog with continuous running surface according to the present invention with the mobile point supported against the left wing, thus the train sense is to the right side over continuous running surface.

In accordance with the drawings, a new and improved frog J with continuous running surface (FIGS. 1 and 2) is shown. The frog J is formed of fitted pieces which are contacted along their upper surfaces by the wheels of the rolling stock.

The mobile point F is mounted in a railroad frog J where a first or left wing 20 and a second or right wing 22 converge toward each other to form the juncture J with a long point rail 24 and a short point rail 26. In the frog J according to the present invention, the long point rail 24 and the short point rail 26 are shaped so that they join together and form a flat vertical surface 28 at the front of the long point rail 24.

The frog J also includes a mobile point member 32 (FIGS. 1-6) abutting along a base or rear portion 32*a* the flat vertical surface 28 at the front of the long point rail 24. The mobile point member 32 extends from the base 32*a* to an apex or point 32*b* (FIGS. 4 and 5) located at a throat 34 (FIG. 1) between the first and second wings 20 and 22.

The mobile point member 32 includes a first point filler member 36 (FIG. 10) which is mounted extending forwardly from the point of juncture 28 to the throat 34. The first point filler member 36 has a first side surface 36*a* (FIG. 10) dimensioned to be fitted along a web portion 20*a* of the first wing 20. Support bolts 38 (FIG. 11) are inserted in order to slide the mobile point to either side through the first wing 20.

A second point filler member 40 is mounted also extending forwardly from the point of juncture 28 to the throat 34. The second point filler member 40 also has a first side surface 40*a* dimensioned to be fitted along a web portion 22*a* of the second wing 22. The support bolts 38 also are inserted through the second point filler member 40 and the second wing 22.

A gap 42 (FIG. 10) is formed between the first and second point filler members 36 and 40 along side surfaces 36*b* and 40*b* over their forward toward the throat 34. The wing filler members 36 and 40 also each have a flat upper surface 36*c* and 40*c* formed thereon adjacent the gap.

An interchangeable insert 44 of the mobile point member 32 having a central bar 46 is insertable in the gap 42 between the first and second point filler members 36 and 40. The insert 44 is mounted when the mobile point F is assembled to rest on the flat upper surfaces 36*c* and 40*c* of the point filler members 36 and 40.

Figure 2:
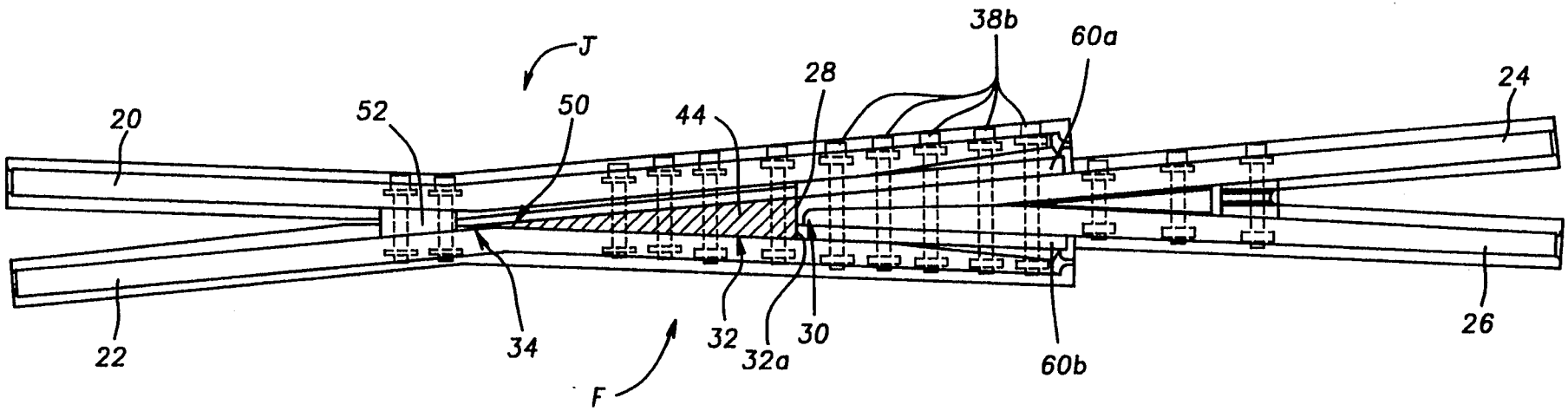
FIG. 2 is a plan view of the frog with the mobile point supported against the right wing, thus the train sense is to the left side over continuous running surface.

The insert 44 has a triangular upper plate 49 extending transversely to the central bar 46. The upper plate 49 is located in the same horizontal plane as the wheel contact surfaces of the point rails 24 and 26. The insert 44 has a tab or lug 48 (FIG. 4) formed extending below the central bar 46. The tab 48 is provided with suitable openings or connectors for engagement by railroad switching gear or stand of the conventional type. The railroad switching gear changes the position of the insert 44 between a first position (FIG. 1) and a second position (FIG. 2). In the first position the mobile point F provides a continuous running surface between the short point rail 26 and the first wing 20. In the second position, the mobile point F provides a continuous running surface between the long point rail 24 and the second wing 22.

The frog J is assembled from the left wing 20 and the right wing 22, the long point 24 and the short point 26. The points 24 and 26 are joined to form the flat vertical surface 28 at the base 32*a* of the mobile point 32. The mobile point 32 extends from the base 32*a* to the point 32*b* at the throat 34. The insert 44 of the mobile point 32 is supported by the filler members 36 and 40 over an area designated generally as 50 adjacent the throat 34. The area 50 would otherwise be an unsupported space or interval between the wings 20 or 22 and the point rails 24 and 26. Thus, in the area where the rolling stock is going to pass through, a continuous running surface is provided with the present invention.

Figure 11:
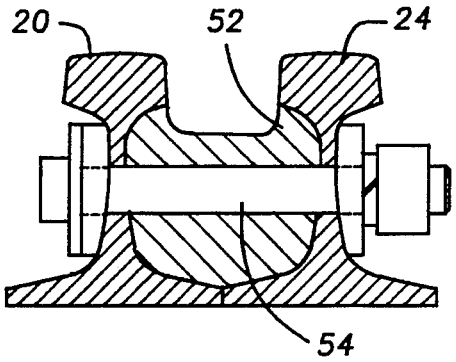
FIG. 11 is a cross-sectional view taken along the lines 11—11 of FIG. 1.
Figure 12:
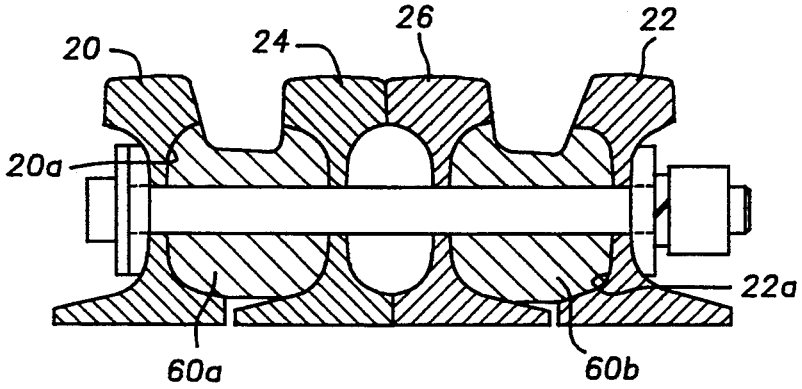
FIG. 12 is a cross-sectional view taken along the lines 12—12 of FIG. 1.

In order to strengthen the frog J at the throat 34 a toe block 52 is bolted by bolts 54 between the wings 20 and 22 (FIG. 11). The strength in the middle of the frog section 12—12 FIG. 1 is provided by the first wing filler 60*a* (FIG. 12) and the second wing filler 60*b* (FIG. 12) which are fastened by the bolts 38*b* to both wings 20 and 22, through the points 24, 26.

Figure 13:
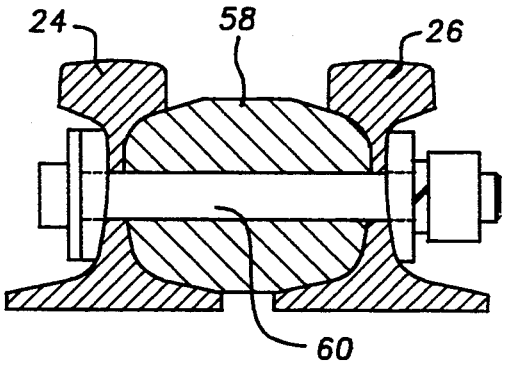
FIG. 13 is a cross-sectional view taken along the lines 13—13 of FIG. 1.

The wing fillers 60a and 60*b* extends between the wings 20,22 and the points 24, 26, from the point of the flat vertical surface 28 to the point at the end of the wings 20, 22. For additional strength at the rear of the frog J, a heel filler block 58 is connected by bolts 60 to the points 24 and 26 (FIG. 13).

Among the advantages of this new improved standard frog with continuous running surfaces are the following:

A) Trains can run through the turnout with the frog J and the mobile point F faster due to the absence of the gap 50.

B) The frog J and the mobile point F is more long lasting. Also, excessive wear of track, the wheels and axles are eliminated.

C) The frog J is less expensive, for it is a modular frog with replaceable insert 44 which can be made with such accuracy that is possible to replace worn or broken pieces when necessary.

D) The frog J is more easily maintainable in situ.

E) The improved standard frog J with continuous running surface can be manufactured with bolted rail or manganese insert.

The present invention thus provides an improved standard frog with a continuous running surface for the railroad turnouts. Further, a continuous running surface for the rolling stock is provided in the form of a mobile point of triangle shape. The mobile point member is supported by either the wing rail 20 or 22, depending on the switch position according to the direction of movement of the rolling stock.

The present invention thus converts a standard frog into one with a continuous running surface. Therefore, higher railroad operating speeds are possible. This is done without impacts both in the axles and the wheels of the railcars and on the balance produced in the rolling stock when running through the standard turnouts.

The improved standard frog continuous running surface for the railroad turnout according to the present invention works by means of the mobile point member 32 which provides a continuous running surface to the rolling stock through the whole frog. Additionally, a frog according to the present invention has other advantages such as easy installation and economy. Due to the replaceable nature of its parts, the parts can be changed when become worn or broken. Additionally, a frog according to the present invention can be operated with any kind of switch stand or similar device.

Having described the invention above, various modifications of the techniques, procedures, material and equipment will be apparent to those in the art. It is intended that all such variations within the scope and spirit of the appended claims be embraced thereby.

I claim:

1. In a railroad frog where first and second wings converge toward each other to form a juncture with a long point rail and a short point rail, an improved railroad frog comprising:

said long point rail and said short point rail forming a flat vertical surface at a point of juncture;

a mobile point member abutting said flat vertical surface at the point of juncture between said long point rail and said short point rail and extending therefrom to a throat between said first and second wings, said mobile point member comprising:

a first point filler member mounted extending forwardly from said point of juncture to said throat and having a first side surface dimensioned to be fitted along a web of said first wing;

a second point filler member mounted extending forwardly from said point of juncture to said throat and having a second side surface dimensioned to be fitted along a web of said second wing;

said first and second point filler members each having second side surfaces forming a gap between them along their forward extent and having a flat upper surface formed thereon adjacent said gap; and an interchangeable insert having a central bar inserted in said gap between said first and second point filler members and mounted on said flat upper surfaces formed thereon.

2. The structure of claim 1, wherein said interchangeable insert is a triangular member having a base extending from said flat vertical surface to an apex at said throat.

3. The structure of claim 1, wherein said interchangeable insert has an upper surface located in a plane of a wheel contact surface of said point rails.

4. The structure of claim 1, wherein said insert and said filler members are laterally movable between said first and second wings.

5. The structure of claim 1, wherein said insert is formed of a higher strength steel than said first and second filler members.

6. The structure of claim 5, wherein said insert is formed from manganese steel.

7. The structure of claim 1, wherein:

each of said first and second point fillers has connector passages formed therethrough;

said interchangeable insert has connector passages formed through it; and said first and second wings have connector passages formed therethrough.

8. The structure of claim 7, further including:

means insertable through said connector passages in said first and second fillers, said interchangeable insert and said first and second wings for connecting them together.

9. The structure of claim 1, further including:

a heel filler block member mounted between said long and short point rails.

10. The structure of claim 9, wherein:

said heel filler block member has connector passages formed through it; and said long and short point rails have connectors passages formed therethrough.

11. The structure of claim 10, further including:

means insertable through said connector passages in said heel filler block member and said long and short point rails for connecting them together.

* * * * *